US005609373A

United States Patent [19]

Gromotka

[11] Patent Number: 5,609,373

[45] Date of Patent: Mar. 11, 1997

[54] LEVER LATCH

[75] Inventor: Gabriel Gromotka, Caledonia, N.Y.

[73] Assignee: Southco, Inc., Concordville, Pa.

[21] Appl. No.: 29,477

[22] Filed: Mar. 11, 1993

Related U.S. Application Data

[62] Division of Ser. No. 838,313, Feb. 20, 1992, Pat. No. 5,267,762.

[51] Int. Cl.[6] ..... E05C 3/02

[52] U.S. Cl. ..... 292/229; 292/DIG. 31

[58] Field of Search ..... 292/113, 229, 292/247, DIG. 31, 129, 181, 210

[56] References Cited

U.S. PATENT DOCUMENTS

| | | | |
|---|---|---|---|
| 2,722,445 | 11/1955 | Cudney | 292/229 |
| 2,927,812 | 3/1960 | Smith et al. | 292/DIG. 31 X |
| 3,030,137 | 4/1962 | Cheney . | |
| 3,237,978 | 3/1966 | Swanson . | |
| 3,259,412 | 7/1966 | Wheeler . | |
| 3,542,410 | 11/1970 | Poe . | |
| 3,998,481 | 12/1976 | Anthone . | |
| 4,114,424 | 9/1978 | Johnson . | |
| 4,134,281 | 1/1979 | Pelcin | 70/208 |
| 4,159,137 | 6/1979 | Richter . | |
| 4,318,557 | 3/1982 | Bourne et al. . | |
| 4,326,221 | 5/1989 | Harmon . | |
| 4,372,591 | 2/1983 | Cook et al. . | |
| 4,487,440 | 12/1984 | Beijer . | |
| 4,602,812 | 7/1986 | Bourne . | |
| 4,693,503 | 9/1987 | Bisbing | 292/229 X |
| 4,743,052 | 5/1988 | Stammreich et al. . | |
| 4,828,299 | 5/1989 | Poe . | |
| 4,877,274 | 10/1989 | Poe . | |
| 4,911,485 | 3/1990 | Wasilewski | 292/DIG. 31 X |
| 4,991,885 | 2/1991 | Poe . | |

FOREIGN PATENT DOCUMENTS

| | | |
|---|---|---|
| 0259108 | 9/1988 | European Pat. Off. . |
| 1575252 | 9/1980 | United Kingdom . |
| 2189539 | 10/1987 | United Kingdom . |
| 2192927 | 1/1988 | United Kingdom . |
| 2199363 | 7/1988 | United Kingdom . |
| 2229761 | 3/1990 | United Kingdom . |
| 2249807 | 5/1992 | United Kingdom . |
| WO8801332 | 2/1988 | WIPO . |

OTHER PUBLICATIONS

Eberhard Manufacturing Co., (Ohio, 1988), pp. I10–I13.
The Hartwell Corporation, (California, 1984).
Southco Fasteners Handbook, (Southco, Inc., Pennsylvania, 1990) pp. E15–E18.
Southco Fasteners Handbook 40, (Southco, Inc., Pennsylvania 1990), p. F–2.
Search Report dated Dec. 16, 1992.
Search Report dated Apr. 2, 1993.

*Primary Examiner*—Rodney M. Lindsey
*Attorney, Agent, or Firm*—Paul & Paul

[57] ABSTRACT

A lever latch secures a door panel of a cabinet or the like in a closed position relative to the frame. The lever latch is installed within an aperture formed in the door, and releasably retains the door against the frame when the door and the frame are latched together. The lever latch includes a housing for mounting in the door, a handle assembly which is pivotally attached to the housing, and rotatable between an opened and closed position, and a fastening member. The fastening member retains the door, when the door is closed against the frame, by engaging the frame as the handle assembly is rotated to the closed position. The housing, handle assembly and fastening member form an integral solid structure for preventing the passage of matter through the latch itself. The lever latch further includes a biasing member which is adapted to retain the handle assembly in the closed position, urge the handle assembly from the closed position to the opened position upon disengagement and provide initial accelerated movement to the handle assembly toward the opened position upon disengagement thereof. A trigger is also included for latching the handle assembly in the closed position, and unlatching the handle assembly from the closed position for movement to the opened position. The trigger which is integrally disposed within the central vicinity of the handle assembly provides increased mechanical advantage during the closing thereof.

24 Claims, 2 Drawing Sheets

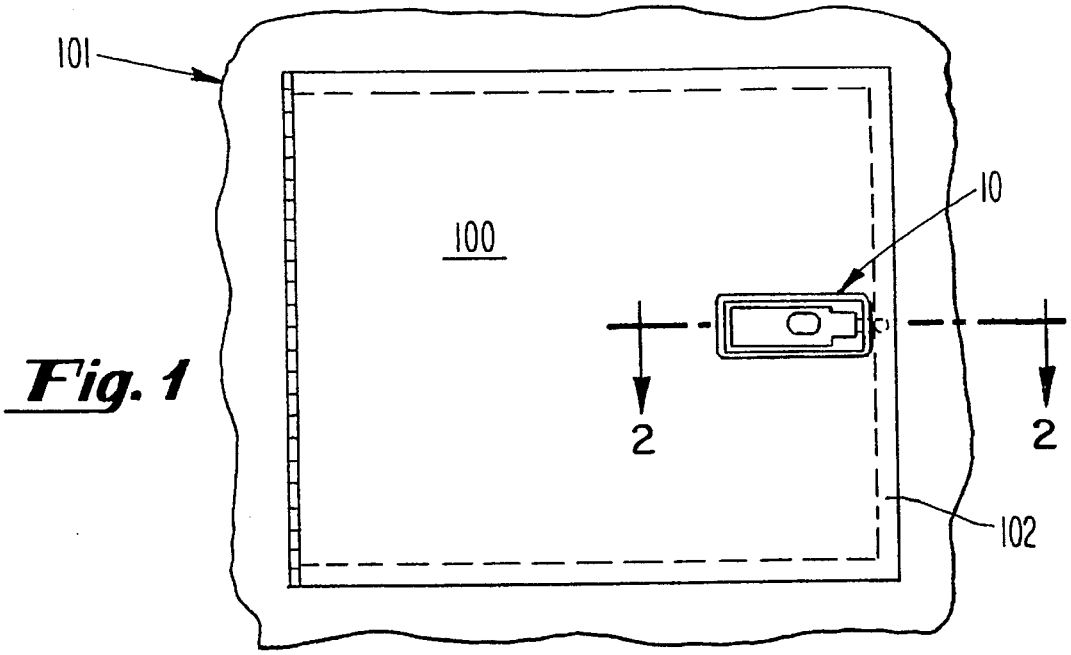
Fig. 1
Fig. 2
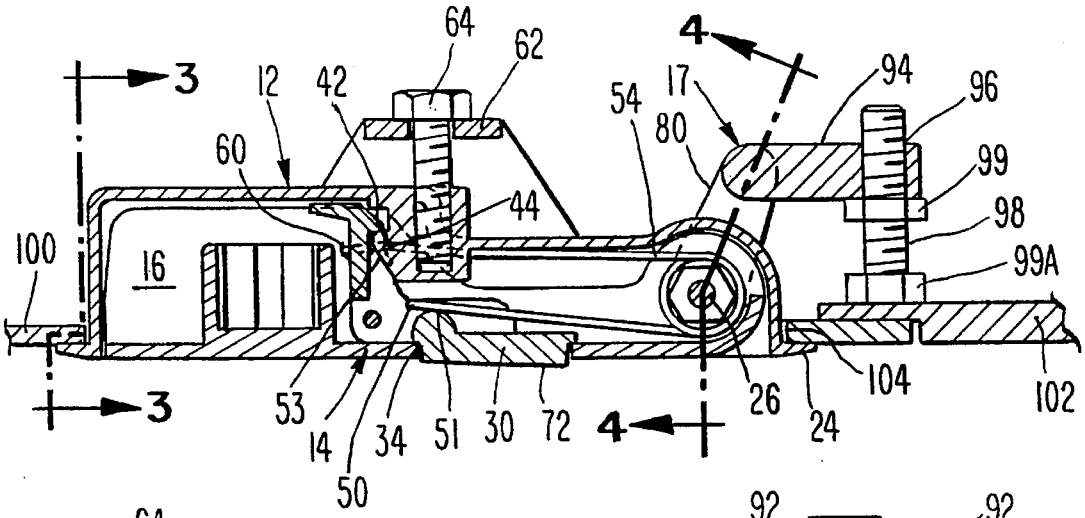
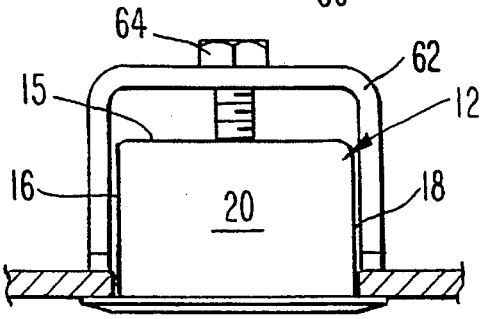
Fig. 3
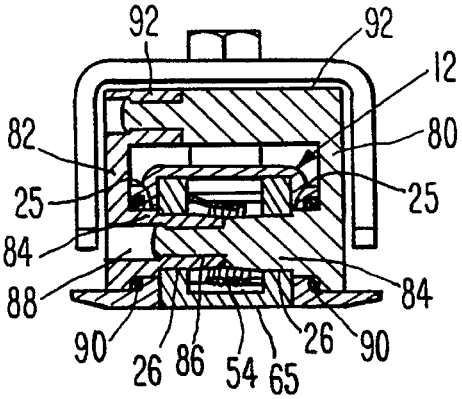
Fig. 4

LEVER LATCH

CROSS-REFERENCES TO RELATED APPLICATIONS

This is a division of application Ser. No. 07/838,313, filed Feb. 20, 1992, now U.S. Pat. No. 5,267,762.

BACKGROUND OF THE INVENTION

1. Field of the Invention

The present invention relates generally to latching devices and more particularly to lever latches for fastening hinged doors, panels and the like.

2. Brief Description of the Prior Art

Various types of latching devices for fastening doors, panels and the like are known.

Some types incorporate a spring to bias a latch bolt into a latched position about a keeper. Rotary handles are provided so that the latch bolt may be rotated away from the keeper in opposition of the spring, and into an unlatched position. However, the handle of such a latch which extends beyond the body may cause inadvertent latching and unlatching in response to impact forces.

Another type are "trigger release lever" latches which incorporate a handle in combination with a trigger in order to compress an arm and a stop against an inner surface of a cabinet frame. The handle and trigger when latched are positioned substantially flush with the outer surface of the door which prevents inadvertent unlatching from the latched position. A housing is included to which the handle is rotatably connected and the trigger of such latches is pivotally connected either to the housing or to the handle. In U.S. Pat. No. 4,693,503, an example of a trigger release lever latch is shown comprising a flanged housing, a handle and a trigger which are inserted within an opening in a cabinet door or the like.

One problem associated with such prior art trigger release lever latches is that a plurality of spring devices are required in order to provide proper function of the latch. For example, in latches where the trigger is pivotally connected to the housing, two springs are required in order to provide proper function. Furthermore, in such latches that provide the trigger as a pivotal part of the handle, two springs, or in some cases three springs, are utilized for proper latch operation. In particular, one spring is used which forces the trigger into the closed position, another moves the handle into the opened position upon release of the trigger, and a third gives the handle an initial rise immediately after trigger release which prevents the trigger from snapping back into the latched position.

Another problem with such prior art trigger release lever latches is that dirt, water and other matter is able to pass through the latch and into the interior compartment of the cabinet, thus causing damage to the equipment contained therein. A latex boot is oftentimes utilized which covers the back of the latch, however, this only provides partial sealing for the latch.

The present invention has been developed in view of the foregoing to overcome the deficiencies of the prior art.

SUMMARY OF THE INVENTION

The present invention provides a lever latch for mounting within a door panel of a cabinet or the like for releasably retaining the door against the corresponding free. The lever latch includes a housing, a handle assembly and a fastening means. The handle assembly, which is pivotally attached to the housing, is rotatable between an opened and closed position. The fastening means retains the door in the closed position against the frame when the handle assembly is rotated to the closed position.

Advantageously, the present invention provides a lever latch which is capable of restricting the passage of matter through the latch itself.

It is a further advantage of the present invention to provide a biasing means in a lever latch which is capable of retaining the handle assembly in the closed position, urging the handle assembly from the closed position to the opened position upon unlatching, and providing an initial accelerated movement to the handle assembly toward the opened position upon unlatching of the device.

It is still a further advantage of the present invention to provide a trigger means in a lever latch which is integrally disposed within the central vicinity of the handle assembly for providing increased mechanical advantage during the closing thereof.

BRIEF DESCRIPTION OF THE DRAWINGS

FIG. 1 is a perspective view of a lever latch of the present invention shown mounted in a door of a cabinet, partly broken away, for securing the door to the cabinet frame, the door being shown in a closed position.

FIG. 2 is a sectional view of the lever latch taken along the Line 2—2 of FIG. 1.

FIG. 3 is a sectional view of the lever latch taken along the line 3—3 of FIG. 2.

FIG. 4 is a sectional view of the lever latch taken along the line 4—4 of FIG. 2.

DETAILED DESCRIPTION OF THE PREFERRED EMBODIMENTS

Figure 6:
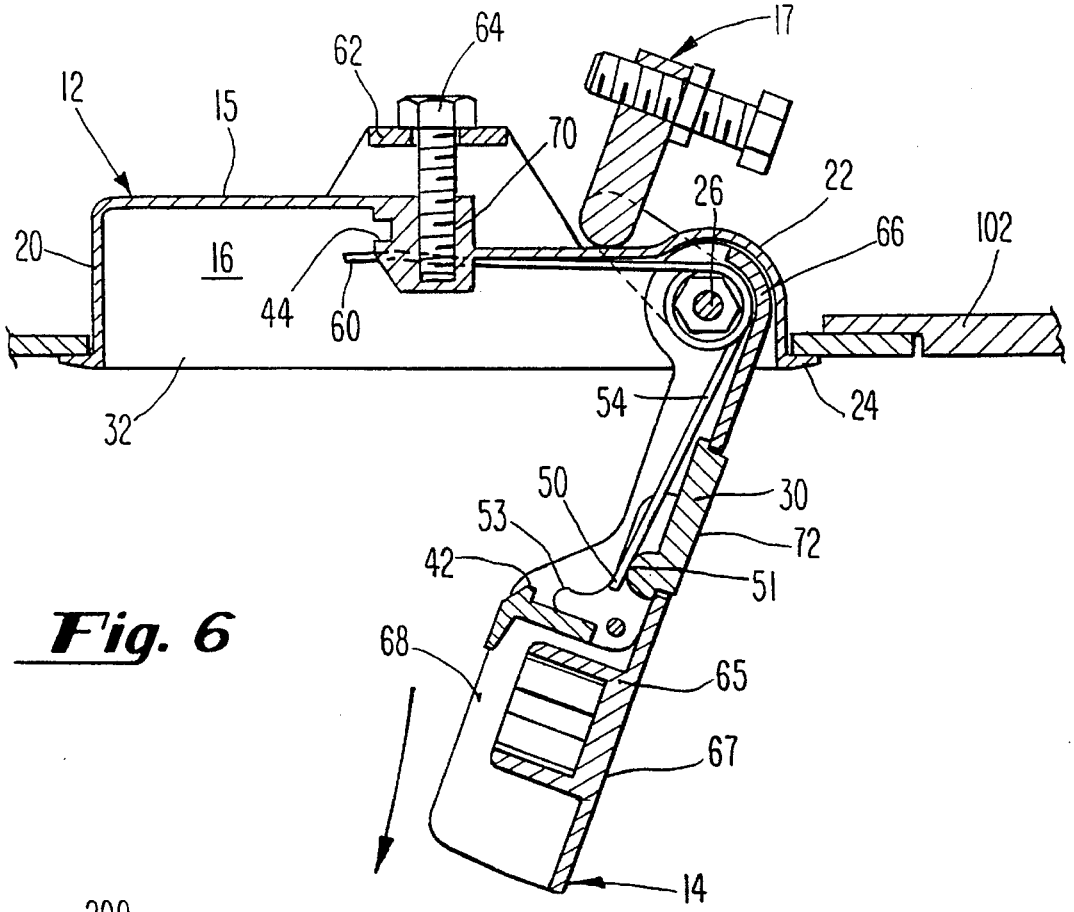
FIG. 6 is a sectional view of the lever latch of FIG. 2 shown in an opened position.

Referring now to the drawings in detail, wherein like reference numerals indicate like elements throughout the several views, there is shown in FIG. 1 a perspective view, partly broken away, of a cabinet 101 having a lever latch 10 of the present invention mounted in a door 100 thereof. The cabinet 101 may be fabricated from any suitable type of material for enclosing various equipment installed therein (not shown). Accordingly, the door 100 as illustrated in phantom in FIG. 1 is hinged to the cabinet 101 for engaging a cabinet frame 102 in a closed position. A gasket (not shown) may be affixed to the inside of the door 100 proximate the edge thereof for providing additional sealing of the door 100 when closed against the frame 102.

As shown in FIG. 2, the lever latch 10 according to the present invention includes a housing 12 for mounting in an aperture 104 formed in the door 100, a handle assembly 14 pivotally attached to the housing 12 and rotatable between an opened and closed position, and a fastening means 16 for engaging the cabinet frame 102 in the closed position.

As best seen in FIGS. 3 and 6, the housing 12 is a generally rectangular, cup-like member that is preferably of a zink die cast. However, the housing 12 according to the present invention may be produced by any appropriate method from any suitable material. Accordingly, housing 12 comprises a bottom plate 15, and a pair of generally parallel side walls 16, 18 and first and second end walls 20 and 22 extending perpendicularly upward therefrom. As best illustrated in FIG. 6, a well 32 is formed between the respective side walls 16, 18 and end walls 20, 22 for housing the handle assembly 14 when in the closed position of FIG. 2. A flange 24 is also provided extending outward from the free ends of sidewalls 16, 18 and end walls 20, 22 for abutting an outer surface of door 100 when housing 12 is mounted proximate the aperture 104 thereof. A sealing means of the gasket type (not shown) may be affixed to the underside of flange 24 for sealing the flange 24 against the outer surface of the door 100 when the housing 12 is mounted therein. Preferably, the flange 24 of the present invention is sized to prevent the passage of matter around the latch 10, through the aperture 104, and into the interior compartment of cabinet 101. Accordingly, oftentimes, it is necessary to incorporate a larger sized flange, preferably about five millimeters in length, in order to account for imperfections in the preparation of door 100 when the housing 12 is mounted therein.

Figure 5:
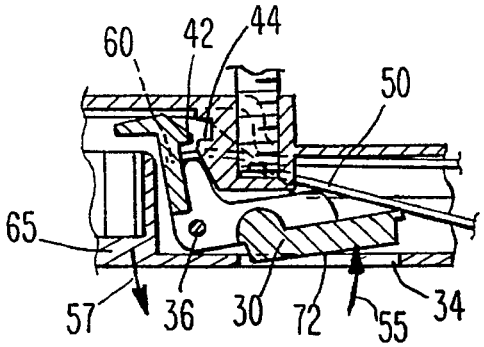
FIG. 5 is a fragmentary sectional view of the trigger of the lever latch shown in a rotated position.

As shown in FIG. 3, the housing 12 is secured within the aperture 104 by the mounting bracket 62. The bracket 62 is received over the outer surface of housing 12, engaging the inner surface of door 100 shown in FIG. 3. The bracket 62 is held in this position, engaging the door 100, by a threaded bolt 64. The bolt 64 is inserted through an opening formed in bracket 62, engaging the threads 70 provided in bottom plate 15 as shown in FIG. 5.

As previously described, the present invention is adapted to prevent the passage of matter through the latch 10, into the interior compartment of the cabinet 101. Accordingly, as illustrated in FIGS. 2 and 3, the sidewalls 16, 18 are each provided with a corresponding opening 25 (not shown in FIGS. 2 and 3) formed therethrough adjacent end wall 22, for receiving the handle assembly 14 and fastening means 17 in the manner described below. At assembly, housing 12, handle assembly 14 and fastening means 17 form an integral solid structure for preventing the passage of matter through the sealed lever latch 10.

As shown in FIG. 6, the handle assembly 14 includes a pivot 65 having a first end 66, an upper surface 67 and opposing side walls 68 (only one of which is visible) extending downward from upper surface 67. Oppositely situated apertures 26 are formed adjacent the first end 66 of pivot 65, within the respective side walls 68 thereof, for receiving the fastening means 17 in the manner described below.

As best seen in FIGS. 2 and 4, the fastening means 17 includes first and second lever members 80 and 82, each having respective first shafts 84 extending from a first end thereof. The first shafts 84 are configured to be received within the openings 25 formed within the sidewalls 16, 18 of the housing 12, and apertures 26 of the pivot 65, respectively. Preferably, the first shafts 84 are hexagonal in cross-section over a section thereof in order to be press fit within the correspondingly configured hexagonal openings 25, and apertures 26, respectively. It should be understood, however, that any appropriately configured first shafts 84, and openings 25 and apertures 26 may be provided for such purpose. As shown in FIG. 4, the first shafts 84 are also formed in such a manner to matingly interconnect along the distal ends thereof, thereby forming a one piece integral shaft member upon assembly. Preferably, the first shaft 84 of first lever member 80 includes an integral rivet member 86 protruding outward therefrom. Accordingly, the rivet member 86 is adapted to be received and peened over within a correspondingly configured receptacle 88 formed through the first shaft 84 of the second lever member 82 for completing the assembly. It is to be understood, however, that any appropriate method may be used for this purpose. A sealing means 90 of the O-ring type may also be included which is received over the respective first shafts 84 for providing additional sealing for the housing 12 against the first shafts 84, respectively. Preferably, the sealing means 90 is of an electrically conductive material for preventing the passage of electromagnetic radiation, however, the sealing means 90 according to the present invention may be produced from any suitable material.

As shown in FIGS. 2 and 4, the first and second lever members 80 and 82 are also provided with respective second shafts 92 extending from a second end thereof. The second shafts 92 are adapted to interconnect in the manner described above, also forming a one piece integral shaft member upon assembly.

As best illustrated in FIGS. 2 and 4, the second shaft 92 of the first lever member 80 is provided with a bracket 94 extending therefrom which includes a threaded opening 96 at its distal end. An adjustable bolt 98 is mounted in the threaded opening 96 and is locked in a fixed position by the action of nut 99. The head 99A of adjustable bolt 99 is positioned to contact the back surface of the frame 102 when handle assembly 14 is moved to its closed and latched position illustrated in FIG. 2.

As shown in FIGS. 2 and 5, the handle assembly 14 also includes a trigger 30 for latching and unlatching the handle assembly 14 from the closed position. As best seen in FIG. 5, the trigger 30 is rotatably mounted onto pivot 65 by a connecting member 36, for example of the spring pin type, the ends of which extending through the aligned apertures formed through the opposing side walls 68 of pivot 65, and trigger 30, respectively. Preferably, as illustrated in FIGS. 2 and 6, the connecting member 36 or second biasing means rotates an outer surface 72 of trigger 30 upward, into the opening 34 formed within the center of pivot 65. Accordingly, the trigger 30 and pivot 65 are contiguous and flush with the flange 24 of housing 12 in the closed and latched position of FIG. 2.

As shown in FIGS. 2, 5, and 6, the trigger 30 also includes a catch 42 formed at the bottom thereof. The catch 42 is adapted to engage in a latched position a keeper 44 formed in the housing 12, when the door 100 is closed against the frame 102 and the handle assembly 14 is rotated to the closed position shown in FIG. 2. As indicated earlier, it is believed that the position of trigger 30 integrally disposed within the vicinity of the center of the handle assembly 14 provides increased mechanical advantage during the closing operation thereof.

As shown in FIGS. 2, 4, and 6, a biasing means 54 of the torsion spring type is included mounted onto the first shafts 84 for retaining the catch 42 in engagement with keeper 44 by the ends 50, 60 thereof. Preferably, as best seen in FIGS. 2 and 5, the end 60 of the biasing means 54 is comprised of a formed section generally bent or otherwise shaped in the direction of the trigger 30 for a purpose described below.

The ends 50, 60 retain the trigger 30 in the latched position of FIG. 2 by engaging and urging upward trigger 30, preferably along a lower side 51 opposite outer surface 72, and a flange 53 formed adjacent the catch 42, respectively.

As shown in FIG. 5, application of force by an operator downward upon outer surface 72 of trigger 30 in the direction of arrow 55 rotates the catch 42 away from keeper 44, and the ends 50, 60 of biasing means 54 urge the trigger 30, and accordingly handle assembly 14, upward in the direction of arrow 57 from well 32. The energy stored in the formed end 60 of the biasing means 54 provides additional thrust or momentum to the trigger 30, and accordingly to the handle assembly 14, which ensures that the catch 42 will not re-engage the keeper 44 when the trigger 30 is released by the operator and rotated back to its original position. Whereafter, the fastening means 17 is moved out of contact with frame 102, as the handle assembly 14 is rotated to the opened and unlatched position of FIG. 5 by the force of the biasing means 54.

Accordingly, the biasing means 54 of the present invention provides three separate operations; it forces the trigger 30 into the latched position, moves the handle assembly 14 into the opened position following release of the trigger 30, and also gives the handle assembly 14 an initial rise of momentum after trigger release by the operator.

Figure 7:
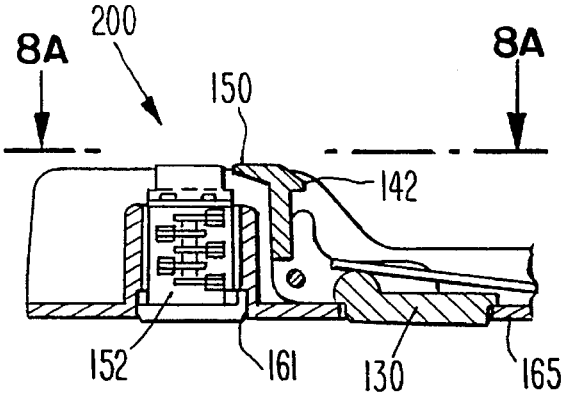
FIG. 7 is a fragmentary sectional view of an alternative embodiment of the lever latch of the present invention.
Figure 8A:
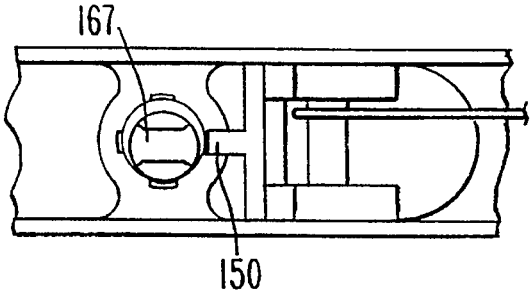
FIG. 8A is a plan view of the lever latch taken along the line 8A—8A of FIG. 7 shown in a closed and unlocked position.
Figure 8B:
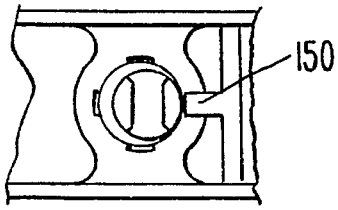
FIG. 8B is a fragmentary plan view of the lever latch of FIG. 7A shown in a closed and locked position.

In FIG. 7 is shown an alternate embodiment of the lever latch of the present invention. A conventional key lock 152 is shown mounted in an aperture 161 formed within the pivot 165 for locking the lever latch 200 in the closed position thereof. As illustrated, the trigger 130 includes a tongue 150 extending therefrom opposite the catch 142. As best seen in FIGS. 8A and 8B, the tongue 150 is configured to extend within a locking slot 167 formed in the lower end of lock 152 when in the unlocked position, and abut against the lower end of the lock 152 when the lever latch 200 is closed and locked.

It will be recognized by those skilled in the art that changes may be made to the above-described embodiments of the invention without departing from the broad inventive concepts thereof. For example, in some circumstances the end 50 of the biasing means 54 can also be utilized as a formed section for providing additional thrust or momentum to the handle assembly 14 upon unlatching. In other circumstances, the end 50 can be utilized exclusively as the only formed section for providing such function. It is understood, therefore, that this invention is not limited to the particular embodiments disclosed, but it is intended to cover all modifications which are within the scope and spirit of the invention as defined by the appended claims.

I claim:

1. A lever latch for mounting in an aperture formed in a door panel for releasably retaining the door panel against a corresponding frame, the lever latch comprising:

a housing;

a handle assembly pivotally attached to the housing, the handle assembly being rotatable between an opened and a closed position, and including detent means associated therewith adapted for retaining the handle assembly in the closed position thereof;

fastening means, the fastening means connected with the housing and handle assembly adapted for engaging the frame for retaining the door when the handle assembly is rotated to its closed position, and biasing means, the biasing means being adapted for biasing the detent means for retaining the handle assembly in the closed position and urging the handle assembly from the closed position to the opened position upon disengagement thereof.

2. The lever latch of claim 1, wherein the biasing means is further adapted for providing the handle assembly with initial accelerated movement toward the opened position upon disengagement of the handle assembly.

3. The lever latch of claim 2, further including means adapted for securing the detent means in the closed position of the handle assembly, and means adapted for disengagement of the handle assembly from the closed position of the handle assembly.

4. The lever latch of claim 3, wherein the securing means includes a keeper disposed within the housing adapted for engaging the detent means of the handle assembly when the handle assembly is in the closed position.

5. The lever latch of claim 4, wherein the securing means and the disengaging means includes a trigger means comprising said detent means, with said trigger means pivotally mounted on and integrally disposed within the handle assembly, the trigger means engaging the keeper when the handle assembly is moved to the closed position of the handle assembly, and the biasing means retaining the trigger means in the closed position of the handle assembly and urging the trigger means and handle assembly to be opened position when the trigger means is disengaged from the keeper.

6. The lever latch of claim 5, wherein the biasing means is further adapted for providing the trigger means and handle assembly with initial accelerated movement toward the opened position upon disengagement of the trigger means.

7. The lever latch of claim 6, wherein the handle assembly includes an opening extending therethrough adapted for receiving the trigger means.

8. The lever latch of claim 6 wherein the biasing means is in engagement with the handle assembly and the trigger means, whereby the trigger means is contiguous with an outer surface of the handle assemby in the closed and opened positions thereof.

9. The lever latch of claim 6, wherein the housing, handle assembly and fastening means are integrally connected forming a seal for preventing the passage of matter through the latch and thereby through the aperture when the lever latch is mounted therein.

10. The lever latch of claim 9, wherein the housing includes flange means extending outward a sufficient amount therefrom for engaging an outside surface of the door panel for preventing the passage of matter around the lever latch and through the aperture when the lever latch is mounted therein.

11. The lever latch of claim 10, further including locking means integrally disposed within the handle assembly for retaining the trigger means in engagement with the keeper when in a closed and locked position of said lever latch.

12. A lever latch for mounting in an aperture formed in a door panel for releasably retaining the door panel against a corresponding frame, the lever latch comprising:

a housing;

a handle assembly pivotally attached to the housing, the handle assembly being rotatable between an opened and a closed position, trigger means, the trigger means being pivotally mounted to the handle assembly for retaining the handle assembly in the closed position thereof, biasing means, the biasing means retaining the trigger means in the closed position and urging the trigger means and handle assembly to the opened position when the trigger means is disengaged from the closed position of the handle assembly, and fastening means, the fastening means connected with the housing and handle assembly adapted for engaging the frame for retaining the door when the handle assembly is rotated to its closed position.

13. The lever latch of claim 12, wherein the biasing means is further adapted for providing the trigger means and handle assembly with initial accelerated movement toward the opened position upon disengagement of the trigger means.

14. The lever latch of claim 13, wherein the handle assembly includes an opening extending therethrough adapted for receiving the trigger means.

15. The lever latch of claim 13, wherein the housing includes a keeper engaging the trigger means when the handle assembly is in the closed position.

16. The lever latch of claim 15, wherein the biasing means is in engagement with the handle assembly and the trigger means, whereby the trigger means is continguous with an outer surface of the handle assembly in the closed and opened positions thereof.

17. The lever latch of claim 15, wherein the housing, handle assembly and fastening means are integrally connected forming a seal for preventing passage of matter through the lever latch and thereby through the aperture when the lever latch is mounted therein.

18. The lever latch of claim 17, wherein the housing includes flange means extending outward a sufficient amount therefrom for engaging an outside surface of the door panel for preventing the passage of matter around the lever latch and through the aperture when the lever latch is mounted therein.

19. The lever latch of claim 18, further including locking means integrally disposed within the handle assembly for retaining the trigger means in engagement with the keeper when in a closed and locked position of said lever latch.

20. A lever latch for mounting in an aperture formed in a door panel for releasably retaining the door panel against a corresponding frame, the lever latch comprising:

a housing, a handle assembly pivotally attached to the housing, the handle assembly being rotatable between an opened and closed position, fastening means, the fastening means engaging the frame for retaining the door when the handle assembly is rotated to its closed position, and means for securing the handle assembly in the closed position, wherein the housing includes a keeper for engaging the securing means when the handle assembly is in the closed position, means for disengaging the handle assembly from the closed position and biasing means, the biasing means being adapted for biasing the securing means for retaining the handle assembly in the closed position, urging the handle assembly from the closed position to the opened position upon disengagement of the securing means from the keeper and providing initial accelerated movement to the handle assembly toward the opened position upon disengagement of the securing means, wherein the securing means and the disengaging means includes a trigger means comprising said securing means pivotally mounted on and integrally disposed within the handle assembly, the trigger means engaging the keeper when the handle assembly is moved to the closed position of the handle assembly, and the biasing means retaining the trigger means in the closed position of the handle assembly, urging the trigger means and handle assembly to the opened position when the trigger means is disengaged from the keeper and providing initial accelerated movement to the trigger means and handle assembly toward the opened position upon disengagement of the trigger means, the handle assembly further including an opening extending therethrough adapted for receiving the trigger means.

21. The lever latch of claim 20, further including locking means, the locking means integrally disposed within the handle assembly for retaining the trigger means in engagement with the keeper when in a closed and locked position of said lever latch, the handle assembly including an opening extending therethrough adapted for receiving the locking means.

22. The lever latch of claim 20, wherein the housing, handle assembly and fastening means are integrally connected forming a seal for preventing the passage of matter through the lever latch and thereby through the aperture when the lever latch is mounted therein.

23. The lever latch of claim 22, further including flange means extending outward a sufficient amount from the housing for engaging an outside surface of the door panel for preventing the passage of matter around the lever latch and through the aperture when the lever latch is mounted therein.

24. The lever latch of claim 20, wherein the biasing means is in engagement with the handle assembly and the trigger means, whereby the trigger means is positioned contiguous with an outer surface of the handle assembly in the closed and opened positions thereof.

* * * * *

UNITED STATES PATENT AND TRADEMARK OFFICE

CERTIFICATE OF CORRECTION

PATENT NO. : 5,609,373

DATED : March 11, 1997

INVENTOR(S) : Gabriel Gromotka

It is certified that error appears in the above-indentified patent and that said Letters Patent is hereby corrected as shown below:

Col. 1, line 67, after the word "corresponding", "free" should be deleted and inserted therefore --frame--.

Signed and Sealed this

Eighth Day of July, 1997

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,609,373
DATED : March 11, 1997
INVENTOR(S) : Gabriel Gromotka

It is certified that error appears in the above-identified patent and that said Letters Patent is hereby corrected as shown below:

Column 6, claim 5,
Line 23, before "opened", "be" should be changed to -- the --.

Column 7, claim 16,
Line 17, "continguous" should be changed to -- contiguous --.

Signed and Sealed this

Fifth Day of March, 2002

*Attest:*

*Attesting Officer*

JAMES E. ROGAN
*Director of the United States Patent and Trademark Office*